US006053463A

United States Patent [19]

Melvin

[11] Patent Number: 6,053,463

[45] Date of Patent: Apr. 25, 2000

[54] UNIVERSAL REMOVABLE MOUNTING SYSTEM

[75] Inventor: Christopher L. Melvin, Katy, Tex.

[73] Assignee: Imonex, Katy, Tex.

[21] Appl. No.: 09/015,849

[22] Filed: Jan. 29, 1998

[51] Int. Cl.[7] ..... A47F 1/00

[52] U.S. Cl. ..... 248/201; 248/909

[58] Field of Search ..... 248/201, 225.11, 248/205.1, 909, 221.11, 222.13, 222.14, 544, 548, 558, 27.1

[56] References Cited

U.S. PATENT DOCUMENTS

| | | | |
|---|---|---|---|
| 375,133 | 12/1887 | Creque | 248/159 |
| 375,412 | 12/1887 | Creque | 248/159 |
| 375,734 | 1/1888 | Creque | 248/159 |
| 1,476,836 | 12/1923 | Pleister | 249/909 X |
| 2,111,357 | 3/1938 | Cornell, Jr. | 248/59 |
| 2,650,870 | 9/1953 | Carpenter | 108/45 |
| 3,094,892 | 6/1963 | Topf | 411/42 |
| 3,384,987 | 5/1968 | Prechtl | 40/757 |
| 3,673,310 | 6/1972 | Welsh | 174/58 |
| 3,835,615 | 9/1974 | King, Jr. | 403/408.1 |
| 3,919,458 | 11/1975 | Perrault et al. | 174/51 |
| 4,007,564 | 2/1977 | Chisholm | 52/98 |
| 4,052,826 | 11/1977 | Chisholm | 52/98 |
| 4,062,165 | 12/1977 | Marks et al. | 52/514 |
| 4,638,608 | 1/1987 | Coy | 52/98 |
| 4,923,319 | 5/1990 | Dent | 403/2 |
| 5,480,121 | 1/1996 | Rice et al. | 248/548 |
| 5,558,455 | 9/1996 | Emery | 403/2 |

*Primary Examiner*—Anita M. King
*Attorney, Agent, or Firm*—Sankey & Luck, L.L.P.

[57] ABSTRACT

The invention is directed to a dual utility support and fastening system which comprises a first body member which is slidably engageable in a housing where the first member includes at least one selectively removable support element. In one embodiment the support element includes an internally threaded bore where the bore extends through the support element into the body.

10 Claims, 2 Drawing Sheets

UNIVERSAL REMOVABLE MOUNTING SYSTEM

BACKGROUND OF THE INVENTION

1. Field of the Invention

The present invention is directed to a dual utility support and fastening system. More specifically, the present invention is directed to a modifiable support system for a body receivable within a housing, where the body defines at least one replaceable mounting member.

2. Description of the Prior Art

There exists a number of common uses for structures which are frangible or which easily fracture in at least one direction. Several variations of breakaway couplings are commonly used for the support of light standards, signs, parking meters and the like. One such assembly is seen in U.S. Pat. No. 4,052,826 as issued to Chisholm. In this assembly, the coupling assembly has a manufactured weakness to promote fracture upon the application of a directional force. Another such example is seen in U.S. Pat. No. 4,638,608 as issued to Coy. Other examples of such couplings or connectors are disclosed in U.S. Pat. No. 3,630,474; 3,572,223; 3,349,531 and 3,521,413. Such breakaway connectors or couplings desirably fail when the supported structure is subject to lateral impact such as may be applied by a colliding automobile.

Other uses for frangible bushings and fasteners are disclosed in U.S. Pat. No. 3,835,615 as issued to King, Jr. As disclosed therein, it is sometimes desirable for a fastener to possess a high tensile strength while demonstrating a weakness to lateral forces. For example, many contemporary coin discriminating assemblies utilize a coin separator which is positioned vis-a-vis a housing member via one or more mounting studs. Such studs are commonly positioned about the periphery of the separator and are slidably receivable in grooves or slots formed in the housing member.

It is often desirable for the coin separator element to be adaptable to a variety of applications which may include differently configured housings. Such adaptability is commonly accomplished by the removal of one or more of the mounting studs for the given application.

The aforedescribed mounting assemblies present a number of disadvantages. The primary disadvantage lies in the fact that once the support member is removed, no economical means then exists to reposition a support member at that location absent a time consuming tapping and threading operation which is often not feasible in the field. In such fashion, the versatility and economy of the support system is severely limited.

SUMMARY OF THE INVENTION

The present invention addresses the above and other disadvantages of prior art fastening and support systems.

The system of the present invention is adapted for use with a first body member which, in one embodiment, is slidably engageable in a housing, where the first member includes at least one selectively removable support element. In a preferred embodiment, the support elements include an internally threaded bore where said bore preferably extends through said support element into said body. In the event the support element is removed, a second threaded element may be attached at the precise location of the first element via the pre-threaded bore.

In one embodiment, the support element may include a weakened area formed immediately proximate said body, where such area is adapted to facilitate a clean fracture of said element in the event its removal is desired.

The present invention presents a number of advantages over the art. One such advantage is a variable geometry mounting system which may be alterably modified depending on the attachment configuration of the housing. In such a fashion, a single manufacture body may be modified in the field to a variety of applications.

DETAILED DESCRIPTION OF THE PREFERRED EMBODIMENT

Figure 1:
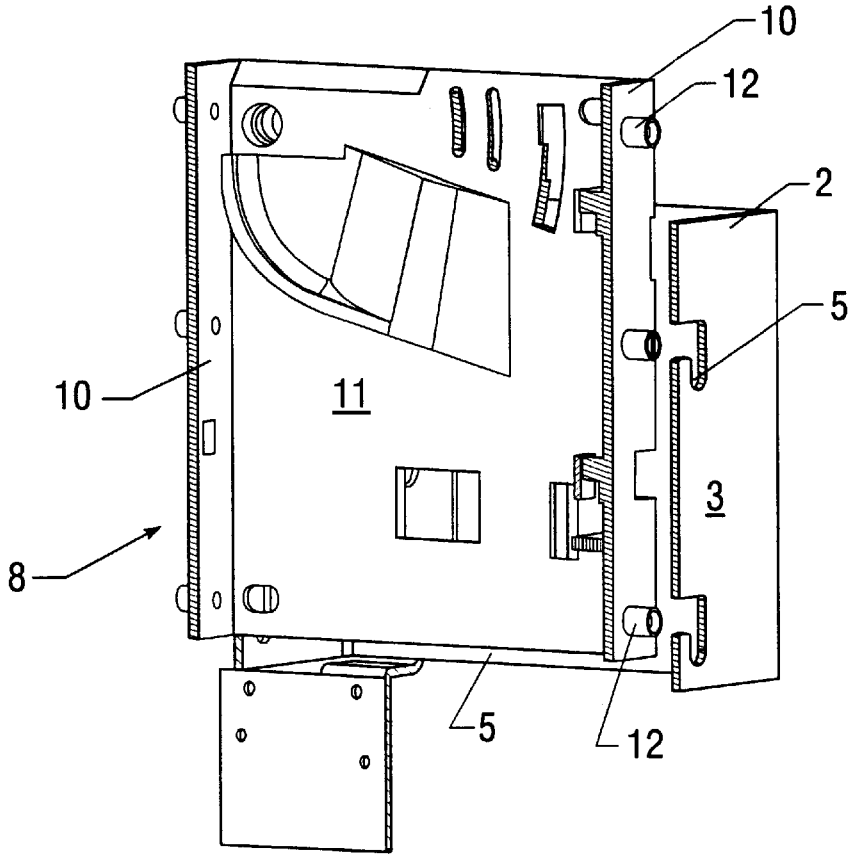
FIG. 1 illustrates a perspective view of one preferred embodiment of the invention.

A preferred embodiment of the mounting system of the invention may be seen by reference to FIG. 1 in which is illustrated a mounting bracket 2 which defines two opposed ends 3 bounding a back member 5. In the illustrated embodiment, ends 3 include one or more "L" shaped mounting slots 4, formed in a conventional fashion. Such a bracket is commonly found, for example, in vending machines, pay telephones, coin operated laundry machines, and other coin operated devices to support and mount a coin discriminator assembly 8. While common to coin operated devices, similar brackets are also found in a plurality of other devices.

Figure 2:
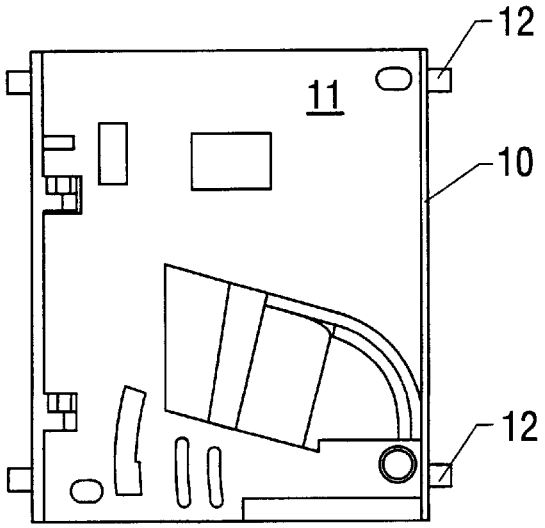
FIG. 2 illustrates a front view of the embodiment illustrated in FIG. 1.
Figure 3:
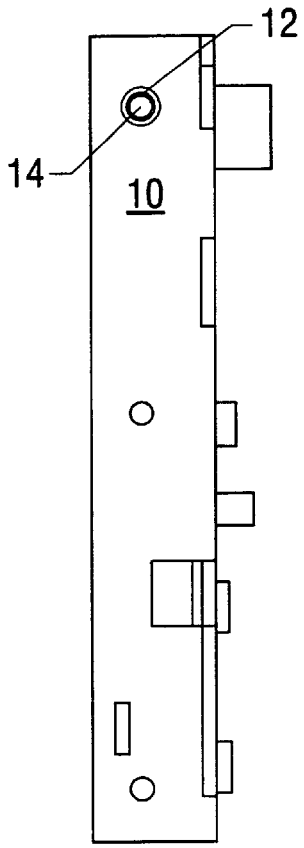
FIG. 3 illustrates a side view of the embodiment illustrated in FIG. 1.
Figure 4:
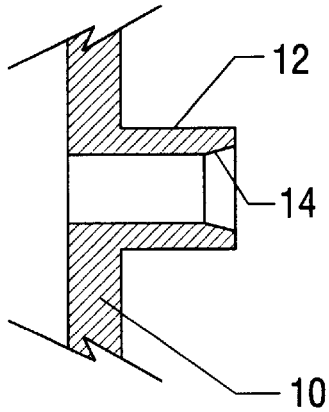
FIG. 4 illustrates a side, cross sectional view of an exemplary mounting stud.

By reference to FIGS. 1–3, bracket 2 is adapted to receive a discriminator element 8 which, in the illustrated embodiment, defines two spaced apart, opposite walls 10 and back portion 11. Walls 10 include one or more support members or mounting studs 12. Studs 12 are adapted to be received in mounting slots 4. In other applications, studs 12 axially received a threaded fastener in a conventional fastener. In a preferred embodiment, studs 12 are formed integrally with walls 10 and may be made of a plastic. In other embodiments, studs may be attached to wall 10, e.g. via a fixative or welding.

By reference to FIGS. 3–6, stud 12 defines a bore 14 therethrough, where said bore 14 preferably extends at least partially through said wall 10. In a preferred embodiment, bore 14 is internally threaded to facilitate the attachment and replacement of stud 12 as will be described below. In other embodiments, stud 12 may be unthreaded or threaded only along a portion of its length.

Figure 5:
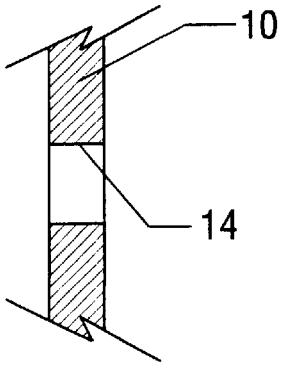
FIG. 5 illustrates a side, cross sectional view of a mounting stud subsequent to fracture.
Figure 6:
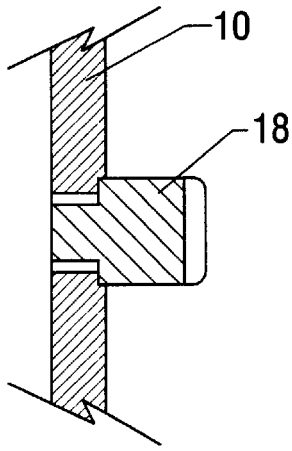
FIG. 6 illustrates a side, cross sectional view of a replacement mounting stud.

Referring to FIGS. 3 and 5, in one embodiment stud 12 is adapted to shear or fracture immediately proximately wall 10 in a fracture zone F. In such a fashion, the supporting system for body 8 may be easily modified for purposes of removal and replacement. If the need should arise to replace a removed stud 12, e.g. when element 8 is used in a different bracket 2 having differently configured mounting slots 4, a replacement stud 18 may be inserted in bore 14.

Although particular detailed embodiments of the apparatus and method have been described herein, it should be understood that the invention is not restricted to the details of the preferred embodiment. Many changes in design, composition, configuration and dimensions are possible without departing from the spirit and scope of the instant invention.

What is claimed is:

1. A mounting system comprising:

a mounting frame including a base member, and a first support member detachably secured to said base member, where said first support member defines an axial, threaded bore therethrough, where said first support member is adapted to bear lateral forces through said mounting frame at an angle transverse to the axis defined by the bore, where said bore is at least partially disposed through said base member such that the removal of said first support member defines at least a partially threaded bore, where said bore is receivable to a second support member.

2. The system of claim 1 where said first support member is integrally formed with the base member.

3. The system of claim 1 where said support member defines a fracture zone to facilitate its detachment from said base member.

4. The system of claim 3 where said fracture zone is formed immediately proximate the intersection of the base member and the support member.

5. A modifiable attachment system including a mounting frame having at least one attachment site for use with bodies having spaced apart side edges where said bodies are adapted to be received in said frame, said system comprising:

first elongate support elements integrally formed with yet detachable from said frame so as to form a point of intersection; where said first support elements define an axial bore therethrough where said bore extends at least partially through said frame such that the removal of said first support element defines an attachment site on said frame receivable to a second, non-integrally formed support element.

6. The system of claim 5 where said axial bore is threaded.

7. The system of claim 5 where said first support element defines a weakened area to promote fracture upon the application of a sufficient force transverse to said axial bore.

8. The system of claim 7 where said weakened area is formed immediately proximate the boundary of the point of the intersection between said first support element and said frame.

9. A mounting system comprising:

a mounting frame having a first member and a second member detachably secured to a first member, where said second member distends outwardly from said first member so as to provide support for said first member;

said first and second members defining a common threaded bore therethrough such that the separation of said first and second members defines a bore defined in said first member receivable to a threaded third member.

10. The mounting system of claim 9 where said first and second members are integrally formed.

* * * * *